United States Patent [19]

te Riele

[11] 4,141,655

[45] Feb. 27, 1979

[54] PROCESS FOR HOMOGENIZING MASSES AND APPARATUS FOR USE THEREIN

[75] Inventor: Johannes H. te Riele, Den Dolder, Netherlands

[73] Assignee: Remia B.V., Den Dolder, Netherlands

[21] Appl. No.: 812,649

[22] Filed: Jul. 5, 1977

[30] Foreign Application Priority Data

Jul. 7, 1976 [NL] Netherlands ..... 7607527

[51] Int. Cl.[2] ..... B01F 11/00

[52] U.S. Cl. ..... 366/118; 366/293

[58] Field of Search ..... 259/6, DIG. 30; 366/108, 113, 117, 118, 293, 294, 295, 296

[56] References Cited

U.S. PATENT DOCUMENTS

| | | | |
|---|---|---|---|
| 2,240,841 | 5/1941 | Flynn | 259/6 |
| 2,932,494 | 4/1960 | Wales | 366/117 |
| 3,744,763 | 7/1973 | Schnering | 259/DIG. 30 |
| 3,912,236 | 10/1975 | Zipperer | 259/DIG. 30 |
| 3,940,115 | 2/1976 | Zipperer | 259/DIG. 30 |
| 3,998,433 | 12/1976 | Iwako | 259/DIG. 30 |

*Primary Examiner*—Robert W. Jenkins

*Attorney, Agent, or Firm*—Lawrence E. Laubscher

[57] ABSTRACT

Process for homogenizing a mass of substance whereby a fine dispersion of the substances in the mass is effected by moving a vibrating blade through the mass in such a manner that the vibrational energy of the blade is obtained by its speed of movement.

3 Claims, 8 Drawing Figures

PROCESS FOR HOMOGENIZING MASSES AND APPARATUS FOR USE THEREIN

BRIEF DESCRIPTION OF THE PRIOR ART

The present invention relates to a process for homogenizing masses, in particular at least two substance-containing masses, whereby a fine dispersion of at least one of the substances in the other is effected by means of a blade vibrating in the mass to be homogenized.

Such a process, the so-called ultrasonic homogenization, is known. It comprises the step of feeding the material to be processed to the homogenizer, possibly after having been pre-mixed. Feeding takes place by means of a pump under pressure (for example 10–50 atmospheres) and the mass is passed over a blade or cutter present in the homogenizer through a specially formed inlet slot.

Owing to the high speed of the mass leaving the inlet slot the blade will start vibrating ultrasonically (natural resonant ultrasonic frequency). Owing to the cavitational energy generated thereby the mass is homogenized. Consequently, the cavitational energy is ultimately produced by the mass to be homogenized and this renders a relatively high pumping energy necessary, because it has to be used for both the transport of the mass and for pressing same through the relatively narrow inlet slot.

SUMMARY OF THE INVENTION

According to the invention it has been found that homogenization can take place highly economically and without the use of a complicated apparatus, unlike passing the mass to be homogenized across a blade, by moving said blade in the mass in such a manner that the vibrational energy of the blade is mainly due to its speed of movement. During movement through the mass the position of the blade is such that the thin side is facing forward, seen in the direction of movement.

A considerable advantage obtained by applying the process according to the invention is that the energy loss is considerably less than by applying the known process. For in the latter process the whole mass to be homogenized has to be pressed through a slot in order to obtain a sufficient mass velocity. In the method according to the invention it is not necessary to press the mass through such a slot, because the vibrational energy is not produced by the mass but by the movement of the blade itself. Another advantage obtained by applying the process according to the invention is that the transport speed of the mass to be homogenized does not influence the degree of its homogenization, because the energy of movement of the mass with respect to the blade is not produced by the mass but by the blade via a separate energy source.

A further advantage of the process according to the invention is that not only liquids can be mutually homogenized or together with solid substances, but also liquids with gases, such as in preparing light masses, for instance whipped cream of synthetic cream. The homogenization of liquids with gases is not possible by applying the known process or only after taking special steps.

German Pat. No. 483,569 describes a process and apparatus for homogenizing liquids in which blade-like means are moved through the liquid in a direction parallel to the blade plane. However, these blades are restrained on two sides and accordingly they cannot vibrate like the blades used in the apparatus according to the invention. Therefore, the object of the apparatus described in German Pat. No. 483,569 is not to mix two liquids by applying vibrational energy but to effect homogenization while the fluid therein is slightly hydraulically influenced. Thus it is not necessary that the blades vibrate as occurs according to the present invention.

In the method according to the invention the mass to be homogenized is fed to the homogenizer according to the invention in flows of separate masses or possibly pre-mixed. If, for example, two liquids are to be homogenized, pre-mixing may be desirable. If air is to be dispersed in a fat-containing mass to obtain a homogeneous whipped mass, such as is the case when whipping cream, the flows of air and fat-containing composition are preferably fed to the homogenizer in separate flows.

As the vibrational or homogenizing energy can be controlled independent of the mass flow, once through flow of the mass through the homogenizer is in principle sufficient. In special cases it may be desirable to partly branch off the mass leaving the homogenizer and feed same again to the apparatus.

The movement of the blade or cutter through the mass in the homogenizer according to the invention can be effected in different ways. Preferably the blade of cutter is attached to a blade holder and connected to a shaft via an arm or disc, said shaft being adapted to be driven by, for instance, an electric motor.

In this embodiment the mass to be homogenized is preferably pumped in a direction parallel to the drive shaft in the homogenizer, while the homogenized mass leaves the apparatus in a direction substantially normal to said shaft.

The dimensions of the blade or cutter to be used in the homogenizer should be such that it is caused to vibrate under the operating conditions. Important factors in this respect are the surface present in the mass to be homogenized and the thickness of the blade. Suitable blades may have a surface in the mass to be homogenized of 180 $mm^2$ and a thickness of 0.2 mm. It will be clear that since the surface in contact with mass to be homogenized is larger, the thickness of the blade can also be greater and vice versa.

The speed of the blade is controlled in dependence of a number of factors, particularly of the nature and the rate of feed of the mass to be homogenized. A speed of movement (or peripheral speed in case of a rotating blade) of 5–10 m/sec is suitable. In preparing a whipped synthetic cream in which air is homogenized with a fat-containing emulsion a peripheral speed of a rotary cutter of 6.5 m/sec has appeared to be highly suitable at a rate of 100–250 kg/hour of mass to be whipped.

Particularly if a less viscous mass or a mixture of less viscous substances is to be homogenized it may be desirable to pass the mass to be homogenized through a plate provided with brake means or the like arranged in the homogenizer. The plate will generally be positioned in such a manner that the brake means are substantially parallel to the direction of flow of the inflowing liquid and substantially normal to the plane of the vibrating blades or cutters.

By this it is avoided that by means of the rotary blades the mass is rotated, with accompanying energy losses or speed loss of the blades with respect to the mass to be homogenized.

As observed earlier the blade or cutter in an apparatus according to the invention is attached to a blade holder.

For example this blade holder may have such a streamlined form that the mass can flow past the blade and the blade holder without great frictional losses. The blade may also be clamped between two blocks having an opening in such a manner that during operation of the apparatus the mass to be homogenized can move through the opening in the blade holder.

In the last-mentioned embodiment the length of the homogenizer can be kept limited in axial direction if the blades are secured to a rotary shaft.

Numerous compositions can be homogenized while applying the method according to the invention. One example from the margarine industry is the preparation of fat-containing emulsions, margarines, synthetic creams, salad creams, "halvarines" (margarines of reduced fat content) and the like. One example from the cosmetic industry is the preparation of cosmetic creams or toothpastes, while one example from the paint industry is the preparation of paint dispersions.

Other applications are ultrasonic (cold) sterilization, ultrasonic cleaning, etc.

BRIEF DESCRIPTION OF THE DRAWING

Embodiments of the apparatus according to the invention are elucidated in more detail by means of the drawing, wherein.

DETAILED DESCRIPTION

Figure 1:
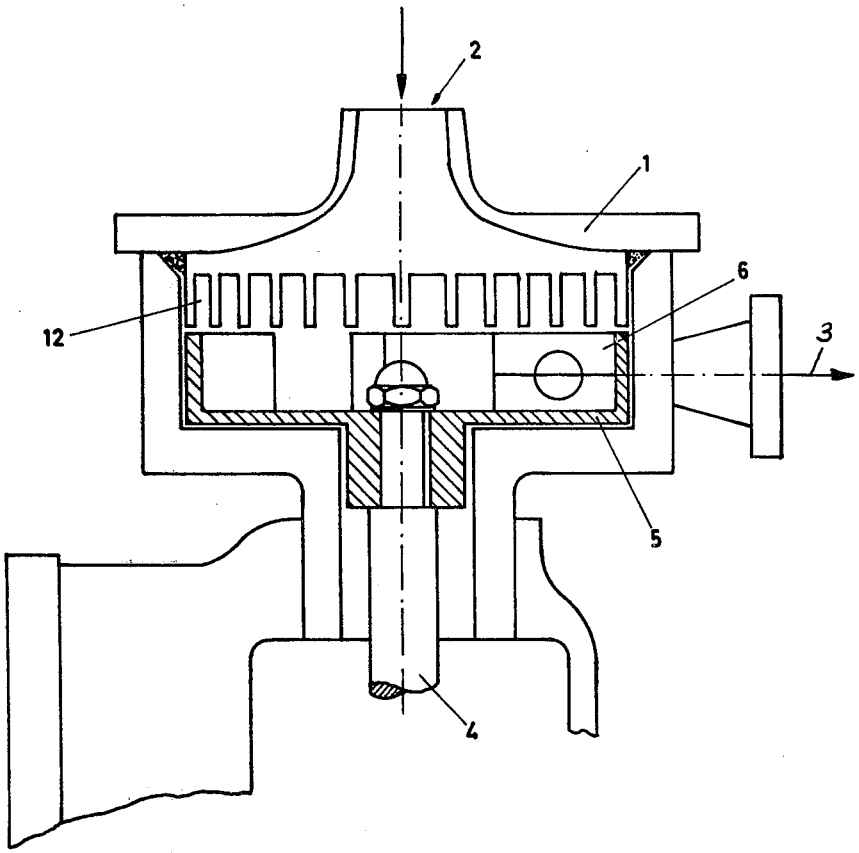
FIG. 1 is a cross-sectional view of a homogenizer.

In FIG. 1, reference numeral 1 indicates the housing of the homogenizer. The mass to be homogenized is fed at 2 and the homogenized mass leaves the apparatus as indicated by arrow 3.

Figure 2:
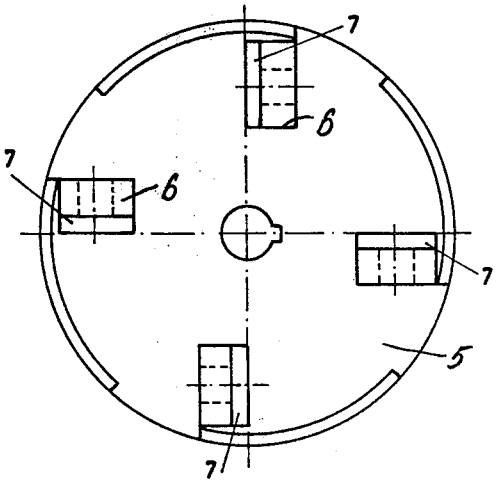
FIG. 2 is a plan view of blades in a homogenizer.
Figure 7:
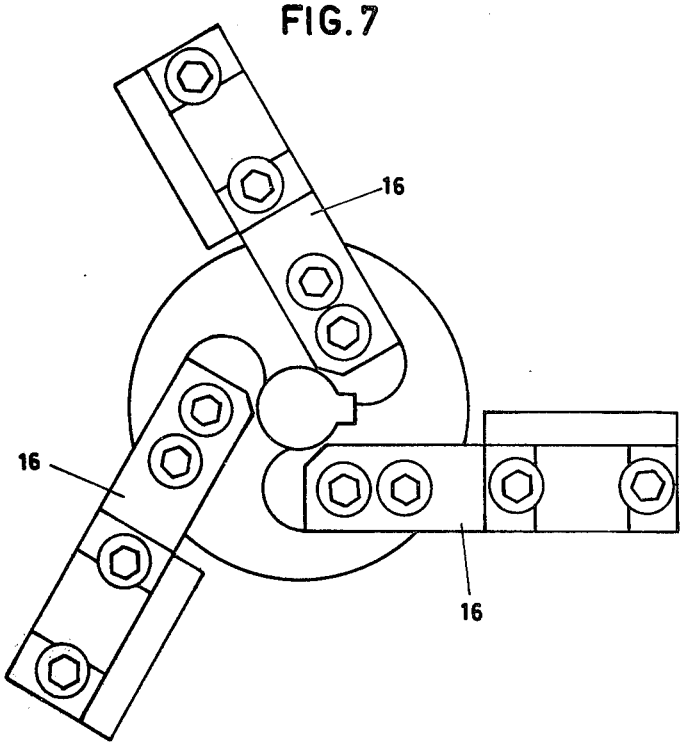
FIG. 7 is a plan view of blade holders attached to arms and FIG. 8 is a cross-sectional view of an apertured blade holder.

Secured to shaft 4 connected to a motor or the like (not shown) is a disc or the like 5 supporting blade holders 6 with blades 7 (FIG. 2). As shown in FIG. 7 the blades and blade holders can be attached, instead of to a disc (5), to arms (16) or the like. An apertured brake means (12) is disposed between the inlet opening 2 and blade holder 6.

In the operative condition shaft 4 and hence blade holder 6 with blade 7 is rotated. The space in the homogenizer is filled with the mass to be homogenized, which is fed at 2.

Brake means 12 prevents the mass to be homogenized from rotating by means of rotary shaft 4.

The homogenized mass leaves the apparatus at 3 and if desired part of it can be returned to inlet opening 2.

Figure 3:
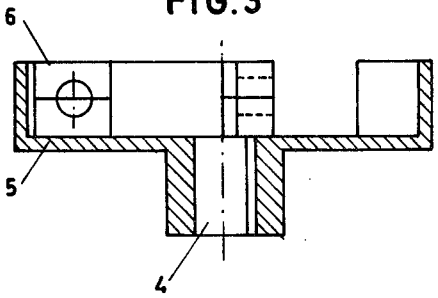
FIG. 3 is a cross-sectional view of a blade in an apparatus as shown in FIG. 2.

FIGS. 2 and 3 show four cutters or blades 7 mounted on the plate or disc 5 and are thus connected to the shaft 4.

Figure 4:
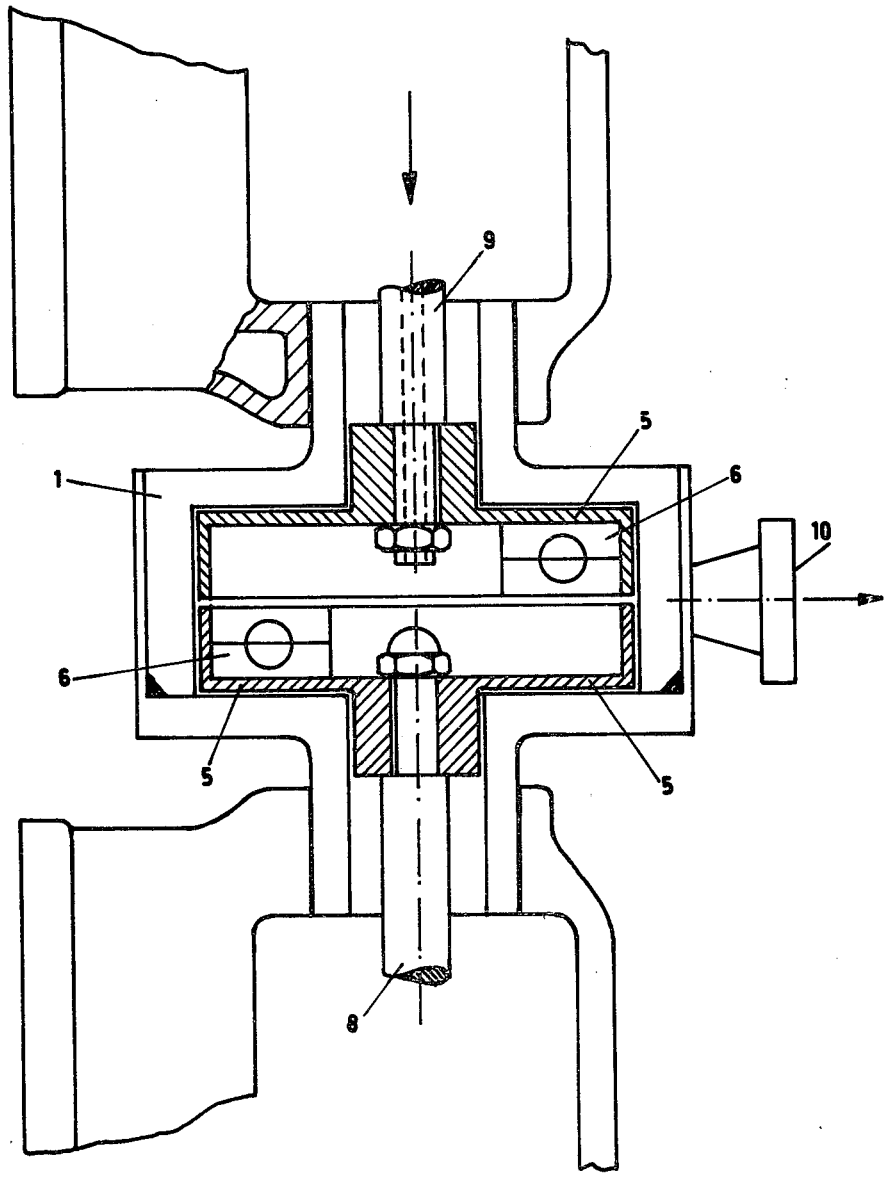
FIG. 4 is a cross-sectional view of a homogenizer having two blades.

FIG. 4 shows a different embodiment of a homogenizer according to the invention.

Secured to each of the shafts 8 and 9, which can rotate independently of one another, is a disc 5 supporting blade holders 6 with blades 7 (not shown). As the shafts are rotatable independently of one another they may have an opposite direction of rotation, thus preventing rotation of the mass to be homogenized. In this embodiment a brake means 12 as shown in FIG. 1 is not necessary. The mass to be homogenized is pumped into the apparatus through hollow shaft 9 and leaves the apparatus through opening 10.

It will be clear that the mass to be homogenized can also be fed to the apparatus through a different inlet, for example along the shaft or by means of an inlet secured to the housing.

Figure 5:
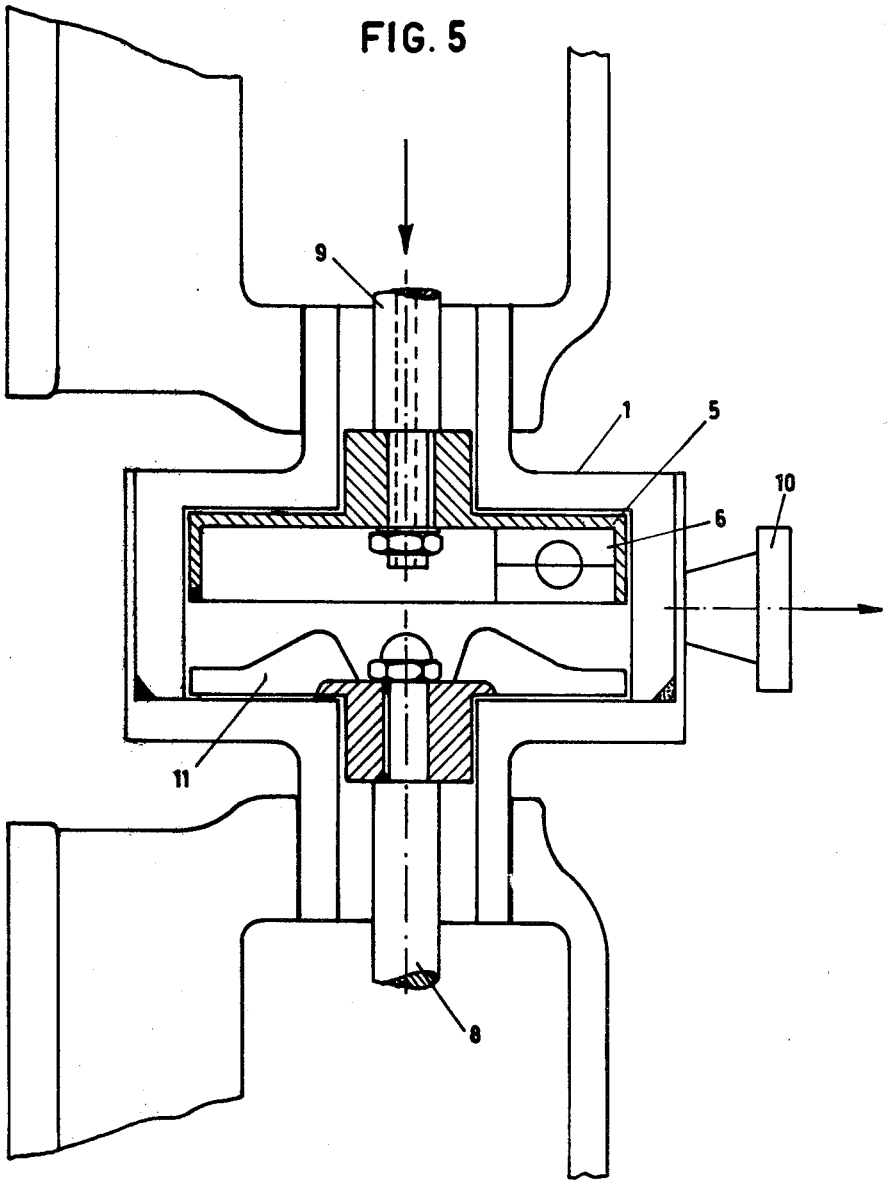
FIG. 5 is a variant of the apparatus shown in FIG. 4, in which one of the arms supporting blades is replaced by a pump impeller.

FIG. 5 shows a variant of a homogenizer depicted in FIG. 4. In this embodiment one of the discs 5 supporting blade holder 6 is replaced by a pump impeller 11. The function of this impeller is to prevent the mass to be homogenized and disposed within the housing from being rotated. However, pump impeller 11 by itself can also have a transporting function, which is particularly possible in case easily pumpable masses are to be homogenized.

Figure 6:
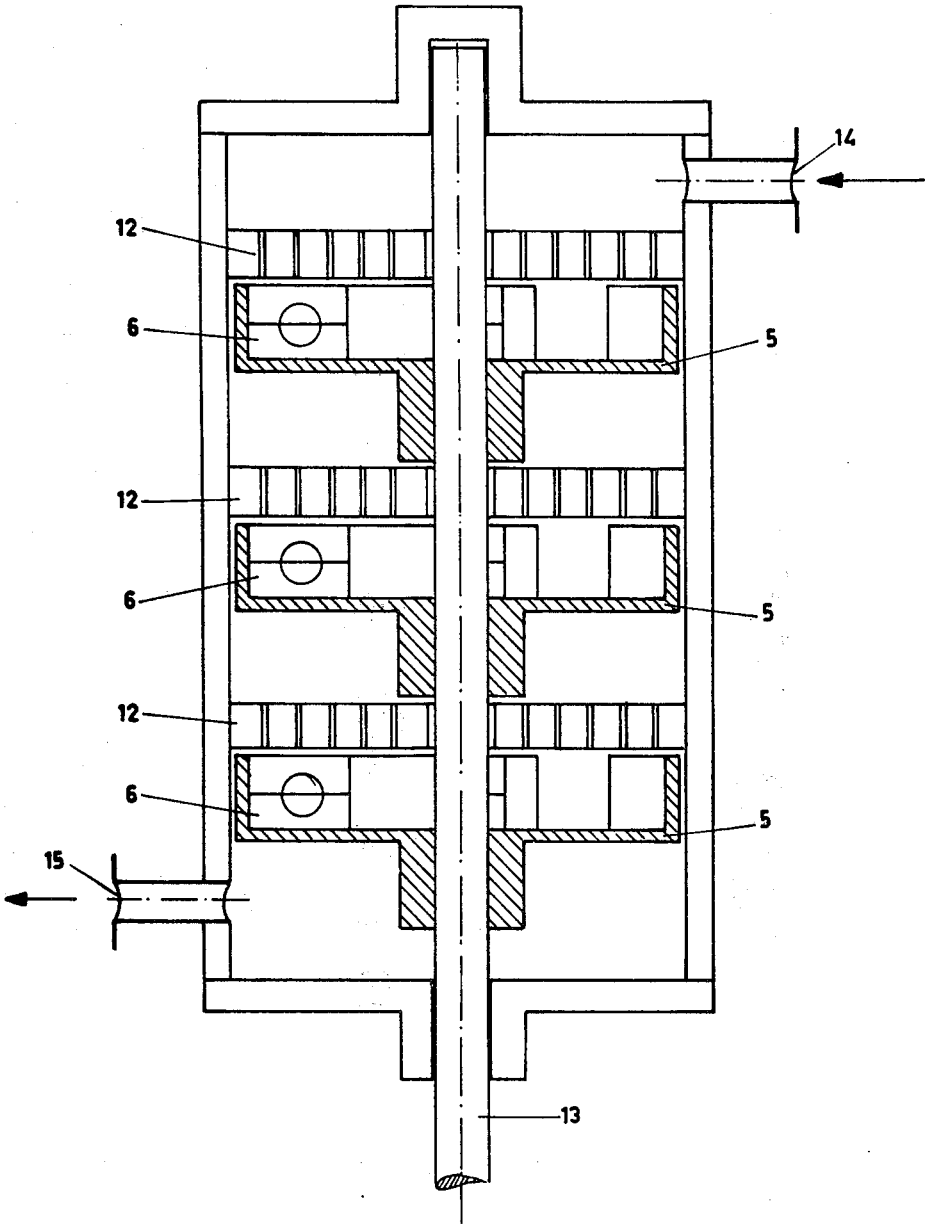
FIG. 6 is a homogenizer comprising blades and brake means disposed in a number of mutually parallel planes.

Finally FIG. 6 shows an apparatus in which a number of discs 5 with blade holders 6 arranged adjacent the spaced brake means 12 respectively are secured in longitudinally spaced relation to a shaft 13. In this apparatus the mass to be homogenized is pumped into the apparatus at 14. The homogenized mass leaves the apparatus at 15. A number of variants of the embodiment shown in FIG. 6 are possible. For instance shaft 13 can be constructed in two parts and the separate shaft portions can be driven independently of one another. In such an embodiment a number of blade holders 6 with blades 7 can rotate in opposite direction, so that a number of brake means 12 are not necessary.

Figure 8:
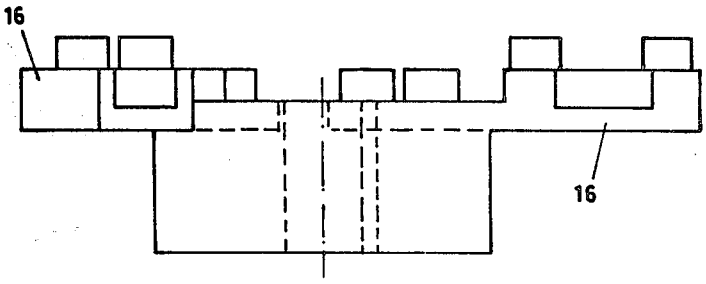

FIG. 8 is a cross-sectional view of an apertured blade holder. In this embodiment, during operation of the apparatus, part of the mass to be homogenized moves through the opening in the blade holder.

I claim:

1. Apparatus for homogenizing a mass containing at least two substances at least one of which comprises a fluid, comprising (a) a housing containing a homogenizing chamber, inlet means for supplying the substances into the chamber to define a mass to be homogenized, and outlet means for discharging the mass from the chamber;

(b) at least one first vibratory blade arranged in said chamber to extend within the mass to be homogenized;

(c) means including a rotary shaft for rotating said first blade about an axis generally parallel therewith and spaced therefrom to effect vibration of said first blade in the mass; and (d) brake means arranged in said chamber and extending normal to the axis of rotation of said first blade for braking the mass against rotation by said first blade, whereby the mass in the chamber is homogenized by said first blade prior to discharge via said outlet means, said brake means including (1) a second vibratory blade arranged in said chamber to extend into the mass on the opposite side thereof from said first blade, and (2) means including a second rotary shaft for rotating said second blade about an axis generally parallel with the axis of rotation of said first blade.

2. Apparatus for homogenizing a mass containing at least two substances at least one of which comprises a fluid, comprising (a) a housing containing a homogenizing chamber, inlet means for supplying the substances into the chamber to define a mass to be homogenized, and outlet means for discharging the mass from the chamber;

(b) at least one first vibratory blade arranged in said chamber to extend within the mass to be homogenized;

(c) means including a rotary shaft for rotating said first blade about an axis generally parallel therewith and spaced therefrom to effect vibration of said first blade in the mass; and (d) brake means arranged in said chamber and extending normal to the axis of rotation of said first blade for braking the mass against rotation by said first blade, whereby the mass in the chamber is homogenized by said first blade prior to discharge via said outlet means, said brake means including a rotary impeller arranged in said chamber and extending within said mass on the opposite side thereof from said one vibratory blade, said impeller being connected with a second shaft for rotation about an axis parallel with the axis of rotation of said first blade.

3. Apparatus as defined in claim 1, wherein said one blade has a surface area of about 180 $mm^2$ and a speed of rotation of from about 5 m/sec to about 10 m/sec.

* * * * *